US010470960B2

(12) United States Patent
Bovard et al.

(10) Patent No.: US 10,470,960 B2
(45) **Date of Patent: *Nov. 12, 2019**

(54) APPARATUS FOR ATTACHING PERSONAL ITEM TO CASKET FOR DISPLAY AS CASKET ORNAMENT

(71) Applicant: Batesville Services, Inc., Batesville, IN (US)

(72) Inventors: Christopher C. Bovard, Sunman, IN (US); Charles A. Malcomb, Hope, IN (US); Daniel G. Meiser, Wilder, KY (US); Ilija Rojdev, Cincinnati, OH (US); Christopher M. Wessel, Metamora, IN (US); Paul Holzman, Mason, OH (US)

(73) Assignee: Batesville Services, Inc., Batesville, IN (US)

( * ) Notice: Subject to any disclaimer, the term of this patent is extended or adjusted under 35 U.S.C. 154(b) by 208 days.

This patent is subject to a terminal disclaimer.

(21) Appl. No.: 15/280,176

(22) Filed: Sep. 29, 2016

(65) Prior Publication Data

US 2017/0014294 A1 Jan. 19, 2017

Related U.S. Application Data

(63) Continuation of application No. 13/787,542, filed on Mar. 6, 2013, now Pat. No. 9,456,949.

(60) Provisional application No. 61/681,488, filed on Aug. 9, 2012.

(51) Int. Cl.
*A61G 17/04* (2006.01)
*A61G 99/00* (2006.01)

(52) U.S. Cl.
CPC ..... *A61G 17/04* (2013.01); *A61G 17/0407* (2017.05); *A61G 99/00* (2013.01); *Y10T 29/49826* (2015.01)

(58) Field of Classification Search
CPC .... A61G 17/00; A61G 17/04; A61G 17/0407; A61G 99/00; A47F 3/005; Y10T 29/49826
USPC ..... 27/19, 10, 2; D99/13; 52/287.1, 288.1; 403/353; 29/428
See application file for complete search history.

(56) References Cited

U.S. PATENT DOCUMENTS 3,025,624 A * 3/1962 Harrell ..... A61G 17/04 27/1
4,571,790 A * 2/1986 James, III ..... A61G 17/04 27/10
6,138,335 A * 10/2000 Drawbaugh ..... A61G 17/04 27/10
6,317,945 B1 * 11/2001 Laphan ..... A61G 17/04 27/10

(Continued)

OTHER PUBLICATIONS

U.S. Appl. No. 61/675,628, filed Jul. 25, 2012.

*Primary Examiner* — William L Miller
(74) *Attorney, Agent, or Firm* — Wood Herron & Evans LLP

(57) ABSTRACT

A method of memorializing a deceased comprises the steps of receiving, subsequent to the death of the deceased and prior to a funeral or other memorial service for the deceased, a selection of a personal item of personal significance to the deceased, attaching the personal item to an ornament base, and attaching the ornament base, with the personal item attached thereto, to a casket for the deceased.

8 Claims, 13 Drawing Sheets

(56) References Cited

U.S. PATENT DOCUMENTS 6,557,222 B2 * 5/2003 Groemminger ..... A61G 17/04 27/10
6,591,466 B1 * 7/2003 Acton ..... A61G 17/04 27/10
6,691,385 B2 * 2/2004 Bell ..... A61G 17/04 27/1
6,928,706 B2 8/2005 Acton et al.
7,117,570 B1 * 10/2006 Borgerding ..... A61G 17/08 27/1
7,200,905 B2 * 4/2007 Cunningham ..... A61G 17/04 27/10
7,260,872 B2 * 8/2007 Schultz ..... A61G 17/04 27/10
7,340,810 B2 3/2008 Acton et al.
7,343,653 B2 * 3/2008 Cunningham ..... A61G 17/04 27/1
7,591,052 B2 * 9/2009 Bovard ..... A61G 17/04 27/10
7,698,792 B1 4/2010 Parker
7,904,998 B2 * 3/2011 Motz ..... A61G 17/045 206/423
7,908,720 B2 * 3/2011 Rojdev ..... A61G 17/04 27/10
8,046,882 B2 * 11/2011 Rojdev ..... A61G 17/04 27/10
8,387,219 B2 3/2013 Rojdev
9,456,949 B2 10/2016 Bovard et al.
2010/0077579 A1 * 4/2010 Parker ..... A61G 17/00 27/10
2010/0077580 A1 * 4/2010 Holzman ..... A61G 17/04 27/10
2010/0299895 A1 * 12/2010 Burlage ..... A61G 17/04 27/14
2012/0266423 A1 * 10/2012 Rojdev ..... A61G 17/04 27/1
2013/0074299 A1 * 3/2013 Rojdev ..... A61G 17/04 27/14

* cited by examiner

APPARATUS FOR ATTACHING PERSONAL ITEM TO CASKET FOR DISPLAY AS CASKET ORNAMENT

RELATED APPLICATIONS

This application is a continuation of U.S. patent application Ser. No. 13/787,542 filed Mar. 6, 2013, now U.S. Pat. No. 9,456,949 issued Oct. 4, 2016, which claims the priority benefit of U.S. Provisional Patent Application No. 61/681,488 filed Aug. 9, 2012, both of which are hereby incorporated by reference herein as if fully set forth in their entirety.

FIELD OF THE INVENTION

This invention relates generally to caskets, and more particularly to ornaments for caskets.

BACKGROUND OF THE INVENTION

There is a trend in the death care industry towards personalizing to the deceased the funeral products and the funeral or other memorial service to provide a more meaningful memorial experience for the family and friends of the deceased. The casket in which the deceased is displayed can be customized to fit the needs and preferences of the deceased and the family. For instance, a wide variety of materials, finishes, colors, and decorative ornamentation can be chosen for the casket.

Some casket designs incorporate decorative or ornamental corner pieces secured to the casket during fabrication thereof. In many, if not most, prior designs, these ornamental corner pieces are rigidly affixed to the casket shell. Consequently, if a customer purchasing the casket is not pleased with the particular pre-installed ornamental corner pieces, and wishes to customize the casket exterior to his or her taste, the funeral director must go through a lengthy and complicated process to first remove the original ornamental corner pieces and then reinstall the ornamental corner pieces chosen by the customer. This process typically requires manual manipulation and access to the interior of the casket which may require the removal of bedding, lining, and the like. Such a process is time consuming and can damage the otherwise new casket and is thus frowned upon and generally avoided by the funeral director.

To more effectively market caskets, the funeral director desires to offer a wide variety of ornamental corner pieces from which a customer can select according to the customer's taste. However, to offer such a wide selection, and to avoid the undesirable practice mentioned above, the funeral director would have to maintain a large inventory of many different casket material/finish and corner piece combinations, which is also undesirable. To minimize the required inventory of finished caskets, the funeral director could simply have one casket of each material/finish provided that the funeral director had some means providing for the quick and efficient changing of the ornamental corner pieces on each casket. As such, the customer could quickly view numerous corner pieces on a single casket, and the funeral director would need only stock a single casket of each material/finish. Prior casket designs, which rigidly affix the ornamental corner pieces, do not permit such quick and efficient changing of the ornamental corner pieces as discussed above.

In response to this need, the assignee devised attachment mechanisms to permit the quick and efficient installation and removal of ornamental corner pieces onto and from caskets.

Examples of such mechanisms are disclosed in the assignee's U.S. Pat. No. 7,591,052 for Quick Change Casket Ornament Attachment Mechanism, U.S. Pat. No. 7,340,810 for Quick Change Casket Corner Attachment Mechanism, U.S. Pat. No. 6,928,706 for Quick Change Casket Corner Attachment Mechanism, and U.S. Pat. No. 6,591,466 for Quick Change Casket Corner Attachment Mechanism, all of which are hereby incorporated by reference herein as if fully set forth in their entirety.

The above noted attachment mechanisms thus allow ready interchangeability amongst whatever casket ornaments are presently available and on hand, thereby providing a casket purchaser with a degree of personalization. However, rather than being limited to the funeral director's stock on hand of casket ornaments, it would be desirable if a family member or loved one could in essence "design and fabricate," at the funeral home at the time of the funeral or other memorial service, casket ornaments with even more meaningful personalization tailored even more specifically to the deceased, that could also be readily attached to the casket.

Accordingly, further advancements in these areas are desired.

SUMMARY OF THE INVENTION

In one aspect, a method of memorializing a deceased is provided. The method comprises the steps of receiving, subsequent to the death of the deceased and prior to a funeral or other memorial service for the deceased, a selection of a personal item of personal significance to the deceased, attaching the personal item to an ornament base, and attaching the ornament base, with the personal item attached thereto, to a casket for the deceased.

In another aspect, another method of memorializing a deceased is provided. The method comprises the steps of selecting, subsequent to the death of the deceased and prior to a funeral or other memorial service for the deceased, a personal item of personal significance to the deceased, directing that the selected personal item be attached to an ornament base, and directing that the ornament base, with the personal item attached thereto, be attached to a casket for the deceased.

In another aspect, a casket is provided. The casket comprises a casket shell adapted to receive a deceased, a casket lid closeable on the shell, and a casket ornament attached to either the shell or the lid. The ornament comprises a personal item of personal significance to the deceased, an ornament base, means for attaching the personal item to the ornament base, and means for attaching the ornament base to the shell or the lid.

The item of personal significance can assume many forms. Examples of the personal item include a hat, a mug, a car, a military medal, a golf ball, a trophy, a doll, a statue/figurine, an article of jewelry, a baseball, a football, a hockey puck, a television remote control, a Bible, a beer bottle, a beer can, a flask, a deck of cards, poker chips, and keys.

The ornament base, means for attaching the personal item to the ornament base, and means for attaching the ornament base to the shell or the lid can also assume many forms. The base can comprise a plate having a plurality of either hooks positioned thereon or openings formed therein for receiving ties to tie the personal item to the plate. The plate can include a tapered female fitting on a rear side thereof into which is received a matingly tapered male fitting. The male fitting can carry at least one stud and preferably a pair of vertically spaced studs or at least one magnet and preferably a pair of vertically spaced magnets for connection to a casket shell corner.

The base can comprise slat wall having a plurality of hooks positioned on the slat wall for receiving ties to tie the personal item to the slat wall.

The base can comprise an L-shaped plate having a shelf portion and a back portion. The back portion can include a plurality of either hooks positioned thereon, tabs positioned thereon, or openings formed therein for receiving ties to tie the personal item to said the portion. The casket back portion can be either narrower or wider than the width of the personal item.

The ornament can further include a transparent cover attached to the base, that either slides on the base, snaps on the base, or that is pivoted to the base. If desired the cover alone can function as the means for attaching the personal item to the ornament base. The cover can have an open top. In one embodiment of open top cover, the upper rim of the open top cover has a resilient grabber element attached around a periphery thereof.

The base can comprise a frame plate having spaced apart generally vertically oriented frame arms movably mounted to the frame plate for horizontal movement.

The accompanying drawings, which are incorporated in and constitute a part of this specification, illustrate embodiments of the invention and, together with the summary of the invention given above, and the detailed description of the drawings given below, serve to explain the principles of the present invention.

BRIEF DESCRIPTION OF THE DRAWINGS

FIG. 2 is a perspective view of the casket shell corner and casket ornament of

FIG. 1.

DETAILED DESCRIPTION OF THE DRAWINGS

Figure 1:
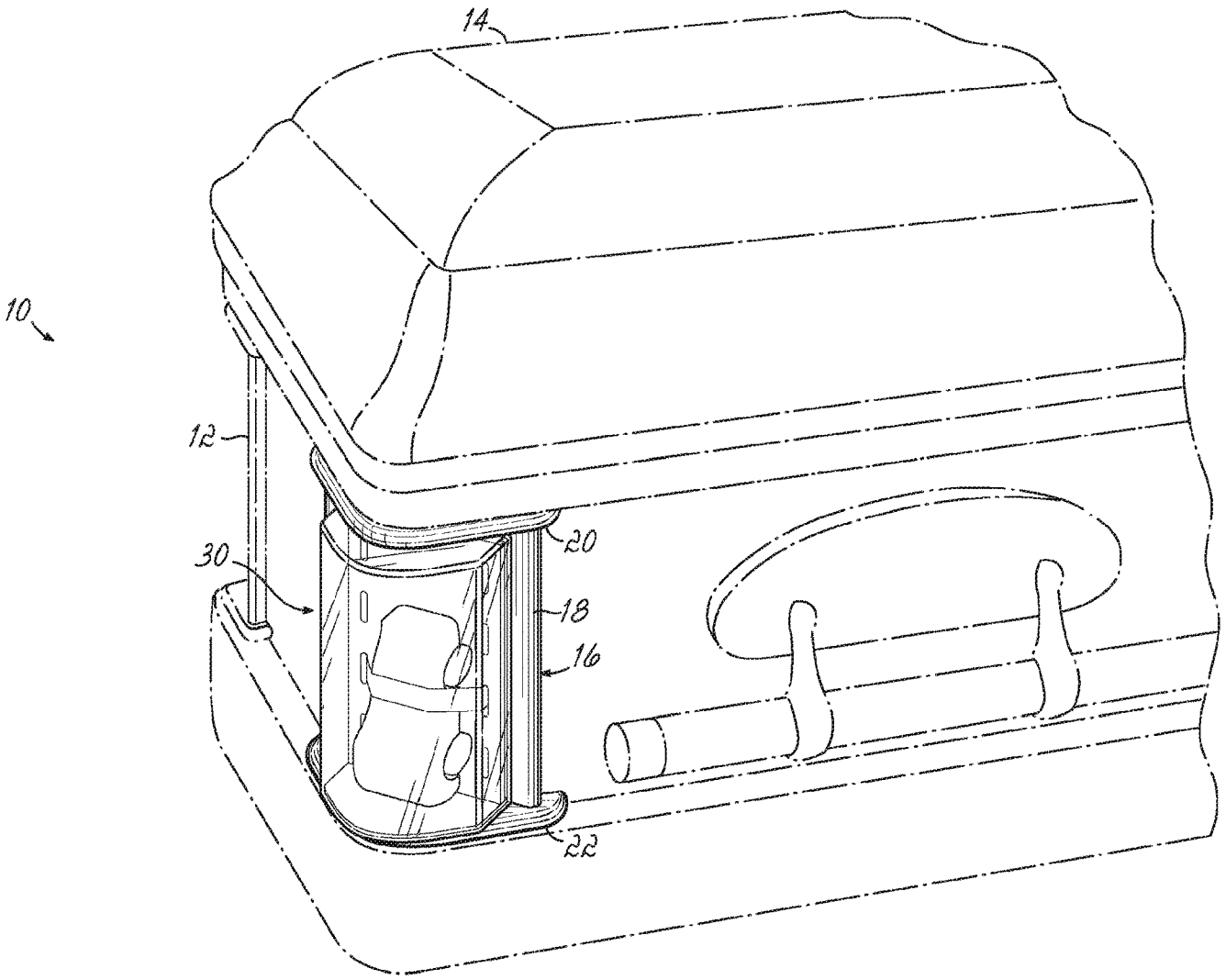
FIG. 1 is a perspective view of a corner portion of a casket according to the principles of one embodiment of the present invention.

Referring first to FIG. 1, a casket 10 has a casket shell 12 and a casket lid 14 closeable on the shell 12. The shell 12 has a corner 16 having a back plate 18, and can have an upper top mold trim element 20, and a lower base mold trim element 22. A casket ornament 30 is illustrated as being attached to back plate 18 of shell corner 16. The ornament 30 can either be removably attached to the back plate 18 or permanently attached to the back plate 18, as desired.

Figure 2:
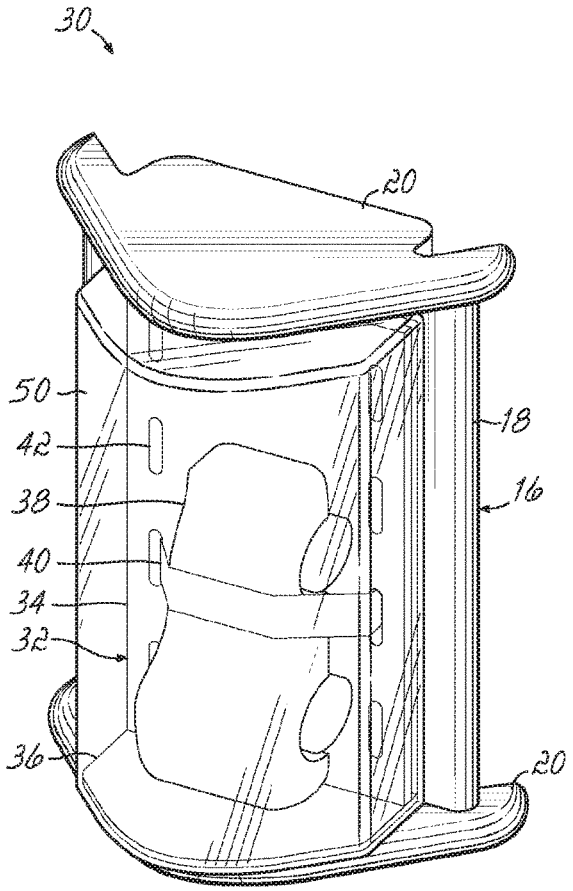
Figure 4:
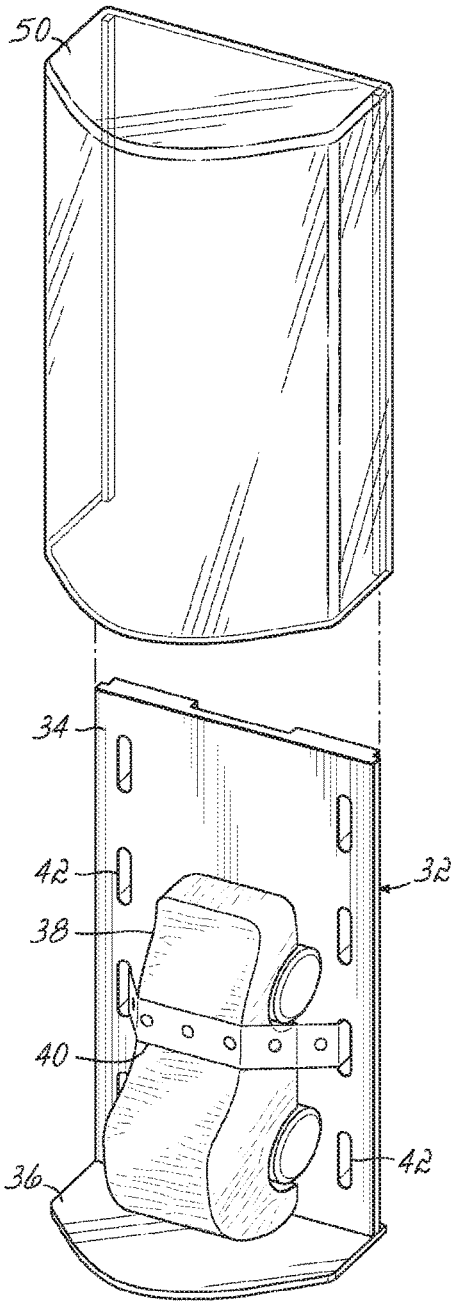
FIG. 4 is a view similar to FIG. 2 with the ornament cover removed.
Figure 3:
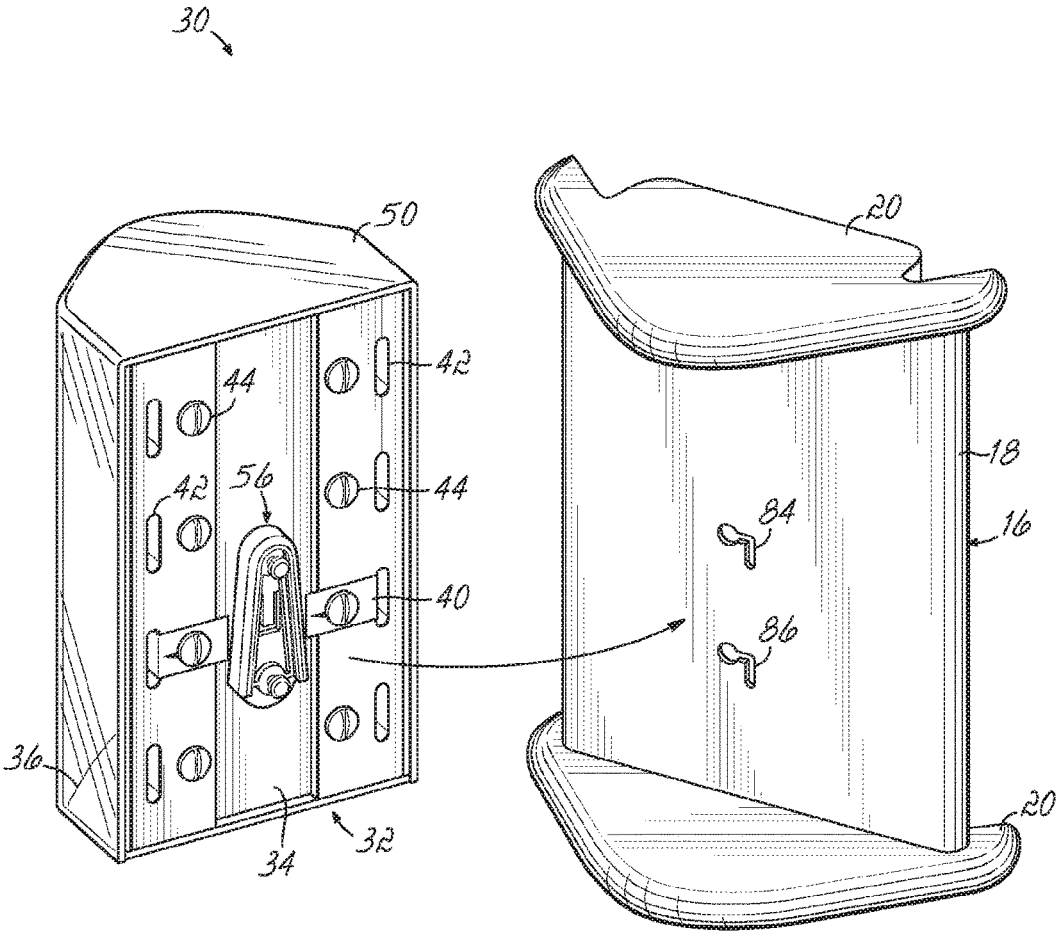
FIG. 3 is a disassembled perspective view of the casket shell corner and casket ornament of FIG. 1.
Figure 5:
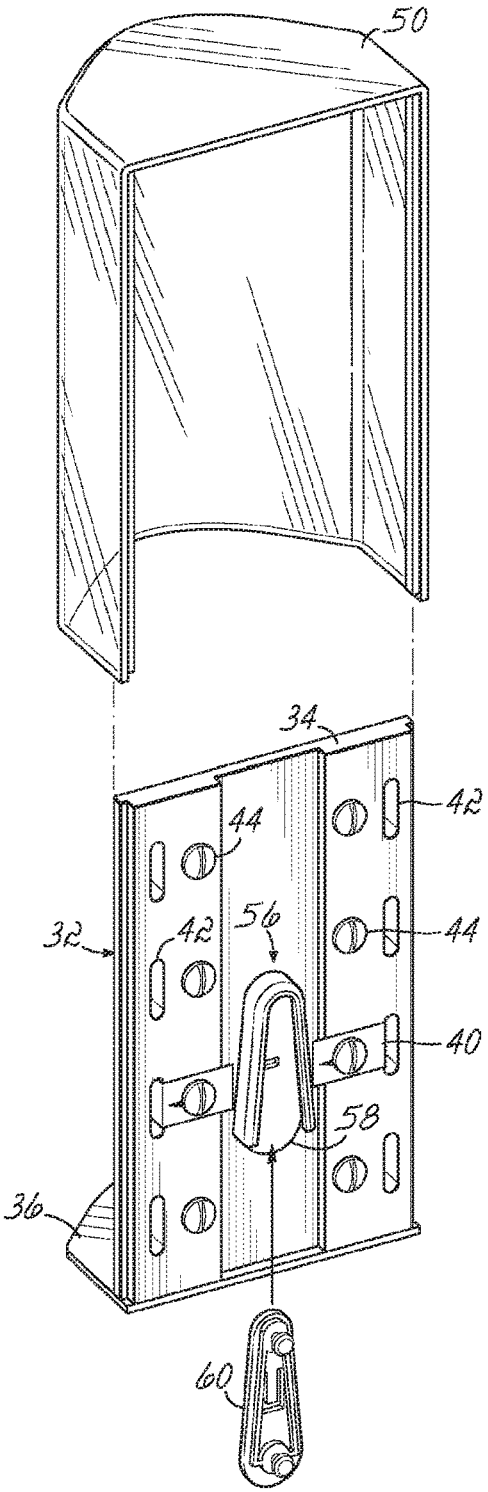
FIG. 5 is a disassembled rear perspective view of the ornament of FIG. 3.
Figure 6A:
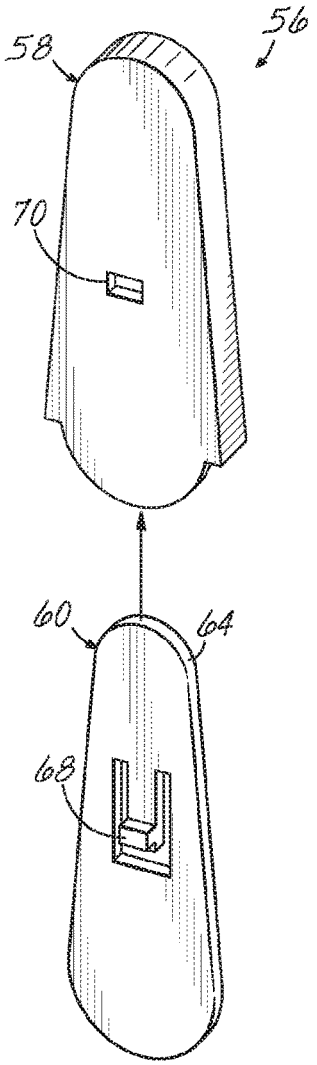
FIGS. 6A-6D are perspective views of various means for attaching the base of the ornament to the shell corner.
Figure 6B:
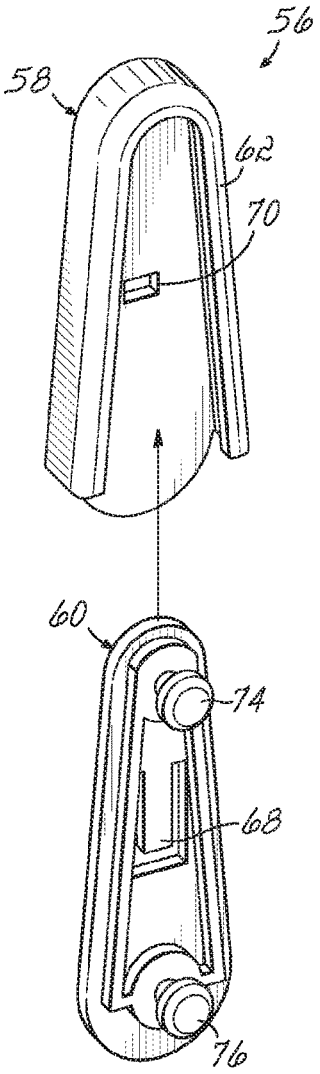
Figure 6C:
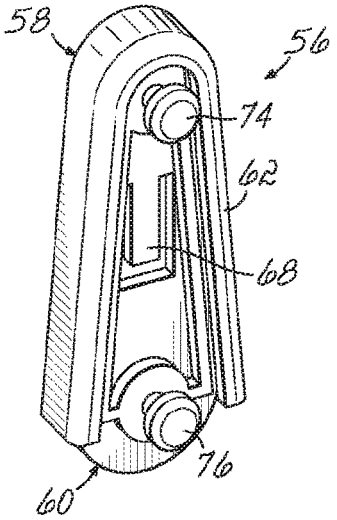
Figure 6D:
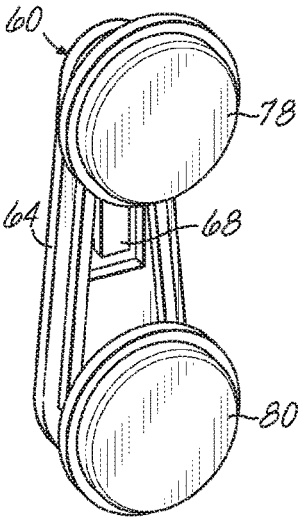
Figure 8B:
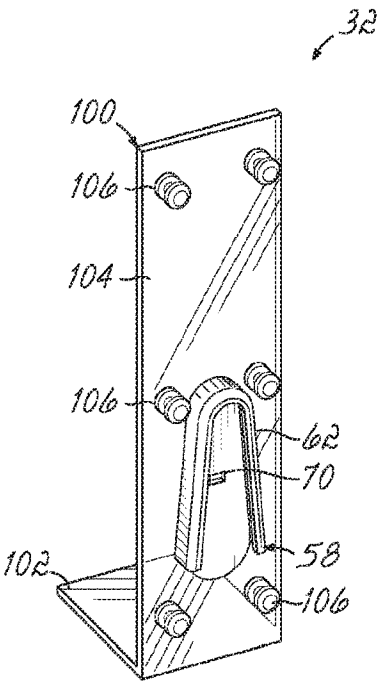
FIGS. 8A and 8B are front and rear perspective views, respectively, of another embodiment of the casket ornament base.
Figure 8A:
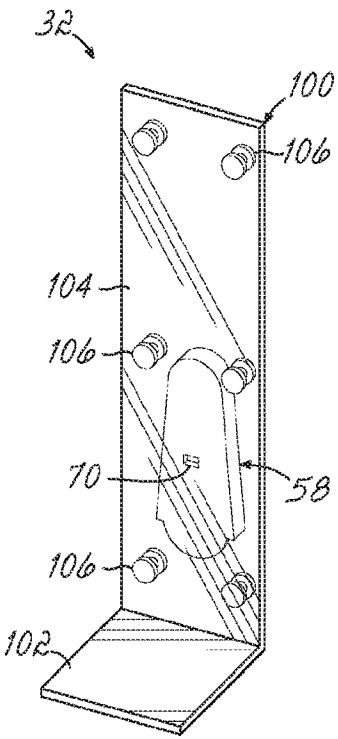

Referring to FIGS. 2-4, casket ornament 30 includes an ornament base 32 which can be planar, or L-shaped having a back portion 34 and a lower shelf portion 36 thereon, or most any other shape. A personal item, for example miniature car 38, is attached to back portion 34 by means such as transparent straps, transparent stretch bands, ties, bands, or the like 40 which pass through openings 42 in back portion 34 and which are secured on a rear side of base 32 via means such as screws, studs, posts, hooks, clips, tabs, or the like 44. A transparent case or cover 50 can be attached, for example slidably attached, to back portion 34 of ornament base 32, if desired. Various embodiments of the ornament embraced by the principles of the invention include the personal item secured to the base with ties and enclosed by the cover attached to the base, the personal item secured to the base with ties but without the cover, and the personal item contained within the cover and the cover attached to the base.

Referring to FIGS. 3, 5, and 6A-6D, one means 56 for attaching casket ornament 30 to casket shell corner 16 is illustrated. A female fitting 58 tapers inwardly and upwardly and accepts a matingly tapered male fitting 60. Female fitting 58 includes a peripheral lip 62 under which is received a peripheral edge 64 of male fitting 60. The male fitting 60 includes a forwardly projecting (away from casket) spring tab 68 that locks into an opening 70 in the female fitting 58 once male fitting 60 is slid completely upward into female fitting 58. A rearward surface (toward casket) of female fitting 60 includes either a pair (preferably, but not necessarily) of vertically spaced studs 74, 76 or a pair (preferably, but not necessarily) of vertically spaced magnets 78, 80. The studs 74, 76 are for use with L-shaped keyhole grooves 84, 86 in back plate 18 of shell corner 16, as shown and described in U.S. Pat. Nos. 7,340,810, 6,928,706, and 6,591,466. Studs 74, 76 can be most any fastener with a head thereon; preferable exemplary and merely illustrative examples include threaded fasteners such as screws, shoulder screws, and the like. The magnets 78, 80 are for use with the magnetic casket corner adapter plate of the assignee's US Patent Application Publication No. 2012/0266423 or with the magnetic cap panel of the assignee's US Patent Application Publication No. 2010/0299895, both of which are hereby incorporated by reference herein as if fully set forth in their entirety.

Figure 7:
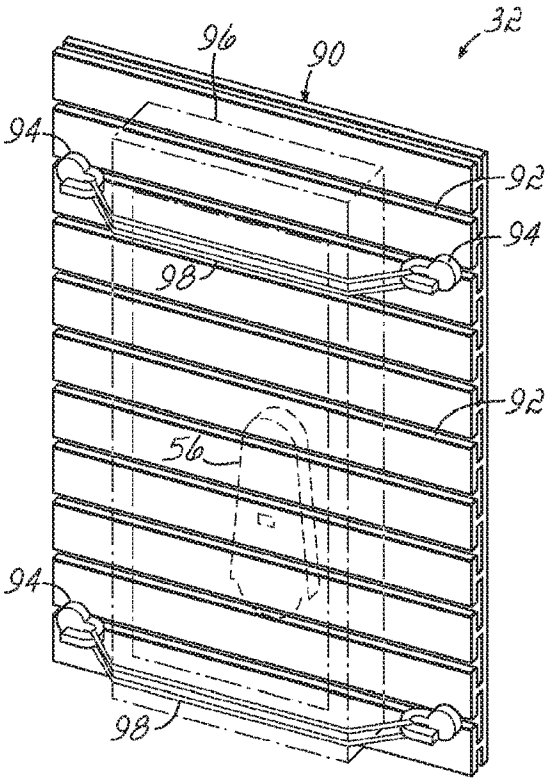
FIG. 7 is a perspective view of another embodiment of the casket ornament base.
Figure 8D:
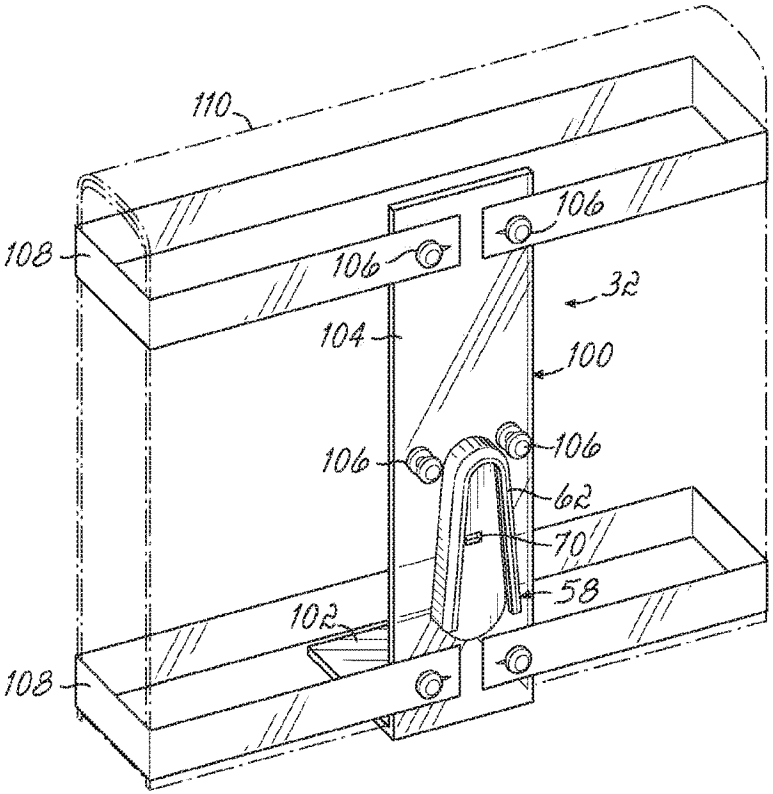
FIGS. 8C and 8D are similar to FIGS. 8A and 8B, respectively, except they show the personal item attached to the casket ornament base.
Figure 8C:
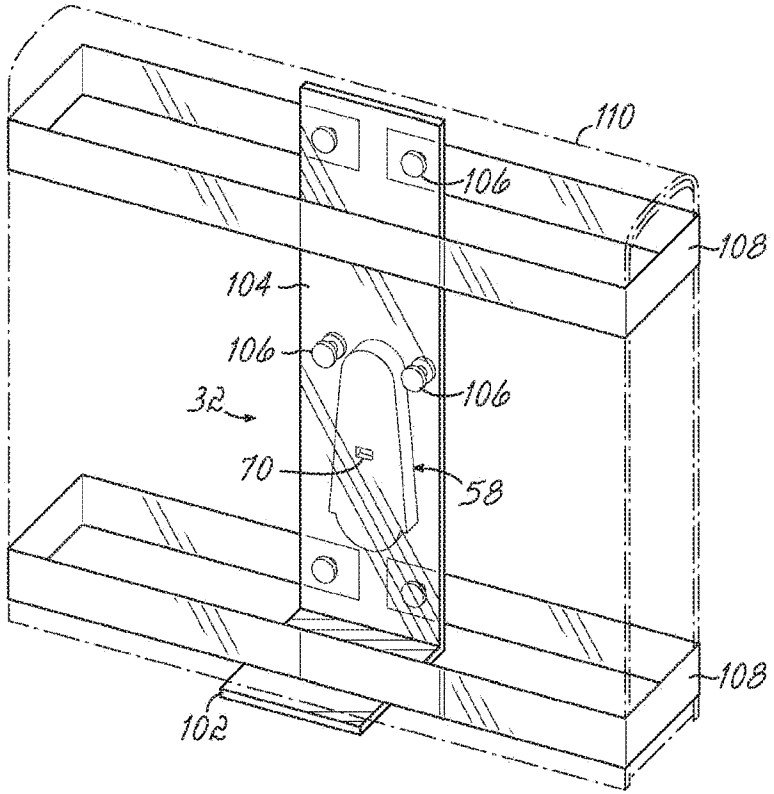

Referring to FIG. 7, another embodiment of ornament base 32 comprises slat wall 90 having a plurality of horizontal grooves or slots 92 that slidably removably accept screws, studs, posts, hooks, clips, tabs, or the like 94.

Personal item 96 is retained with transparent straps, transparent stretch bands, ties, bands, or the like 98.

Referring to FIGS. 8A-D, another embodiment of ornament base 32 comprises a transparent L-shaped plate 100 having a shelf portion 102 and a back portion 104. Attachment means 56 can be secured to a rear side of back portion 104. Back portion 104 can include a plurality of rearwardly directed screws, studs, posts, hooks, clips, tabs, or the like 106 for use with transparent straps, transparent stretch bands, ties, bands, or the like 108 to secure the personal item to the base 32. The back portion 104 can advantageously be narrower than the width of the personal item 110, for example small Bible, secured thereto the base 32.

Figure 9:
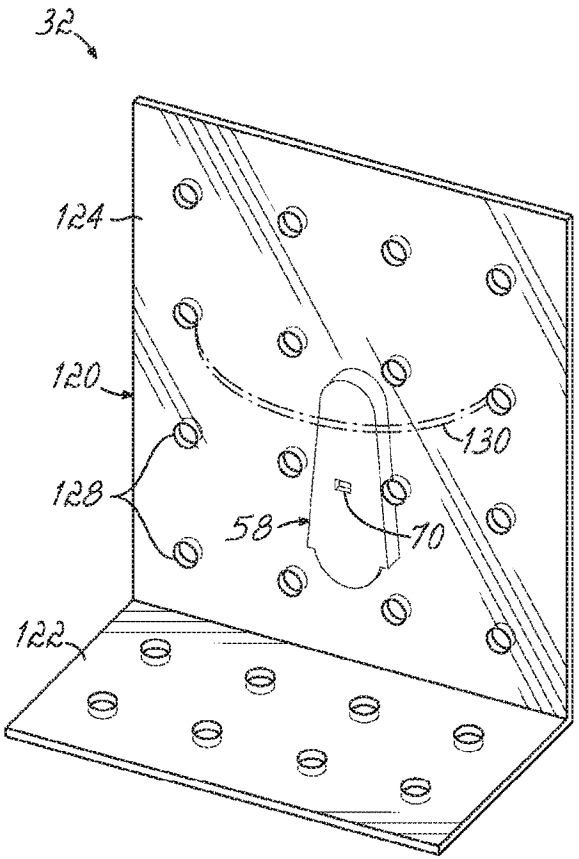
FIG. 9 is a perspective view of another embodiment of the casket ornament base.

Referring to FIG. 9, another embodiment of ornament base 32 comprises a transparent L-shaped plate 120 having a shelf portion 122 and a back portion 124. Either or both of the shelf and back portions 122, 124 can include a plurality of openings 128 for use with transparent straps, transparent stretch bands, ties, bands, or the like 130 to secure the personal item to the base 32. This embodiment includes the prior described attachment means 56.

Figure 10:
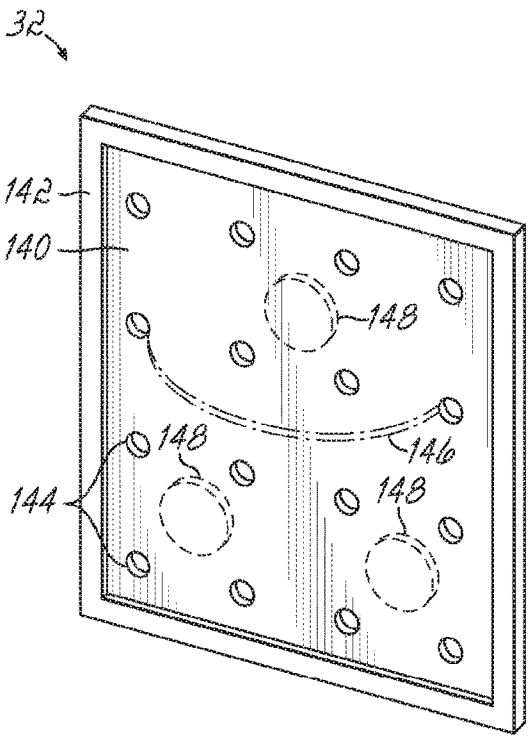
FIG. 10 is a perspective view of another embodiment of the casket ornament base.

Referring to FIG. 10, a similar embodiment of ornament base 32 comprises a transparent planar generally square plate 140 (i.e. does not have shelf) with a raised rim or frame 142 circumferentially therearound. The plate 140 can include a plurality of openings 144 for use with transparent straps, transparent stretch bands, ties, bands, or the like 146 to secure the personal item to the base 32. This embodiment utilizes an attachment means in the form of three magnets 148 secured to a rear side of plate 140.

Figure 11:
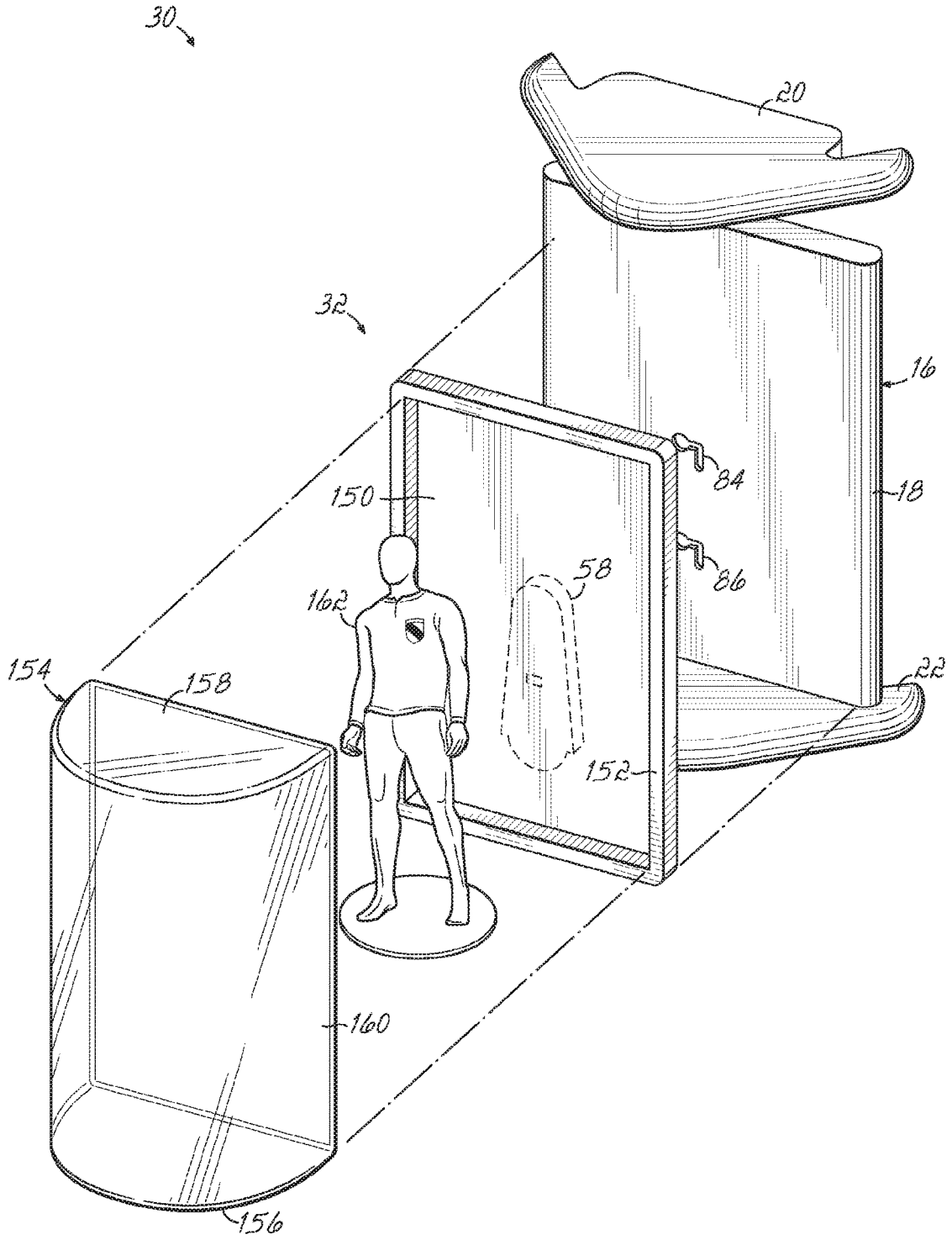
FIG. 11 is a disassembled perspective view of another embodiment of the casket ornament.
Figure 12:
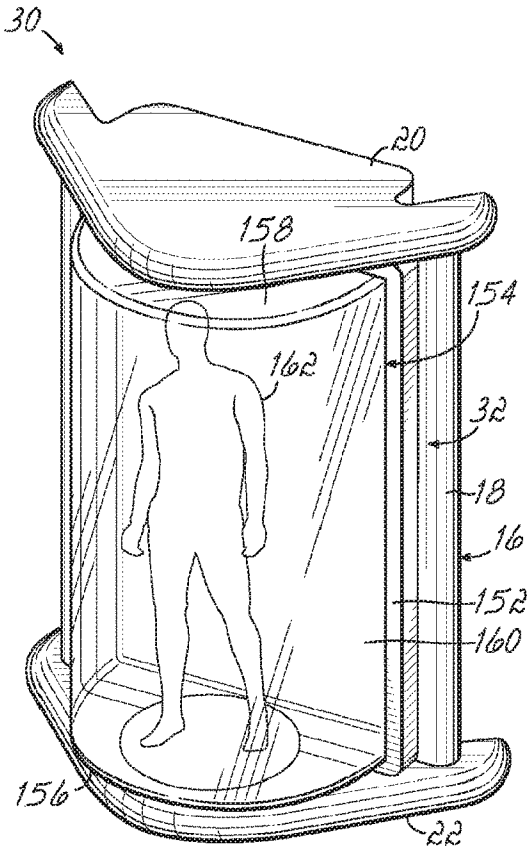

Referring to FIGS. 11 and 12, ornament base 32 comprises a planar generally rectangular plate 150 with a raised rim or frame 152 circumferentially therearound. A transparent cover 154 snaps into or onto rim 152 of plate 150. Transparent cover 154 includes a bottom wall 156, a top wall 158, and a curved, for example semi-cylindrical, front wall 160 interconnecting the bottom and top walls 156, 158. This embodiment is particularly suited to the display of items such as a small statue/figurine 162 which can be placed on and supported by the bottom wall 156 of cover 154, in which case the cover 154 functions as the means for attaching the personal item to the ornament base 32. Of course a myriad of other items other than the small statue/figurine 162 could be attached to the ornament base via cover 154 and supported on bottom wall 156 thereof.

Figure 14:
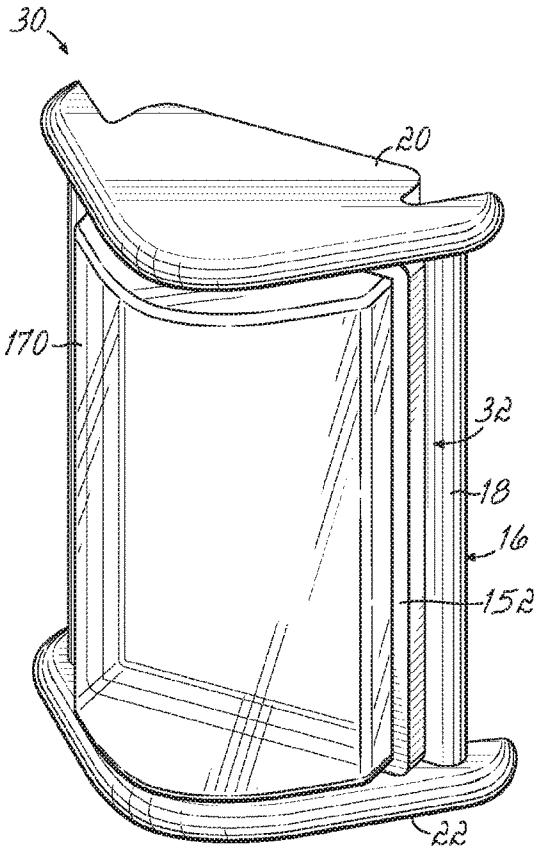
FIGS. 12-15 are similar to FIG. 11 but illustrate various covers for the casket ornament.
Figure 13:
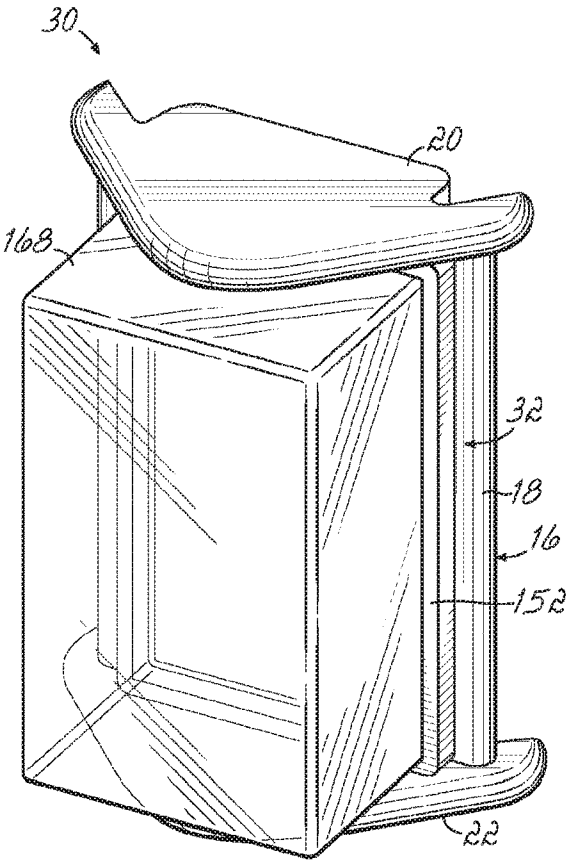

Referring to FIGS. 13 and 14, the transparent cover for ornament 30 can take most any form, such as generally box shaped as shown at 168, or a more tailored profile such as that shown at 170 wherein the transparent cover approximates the profile of the top mold element 20 and base mold element 22 of the shell corner 16.

Figure 15:
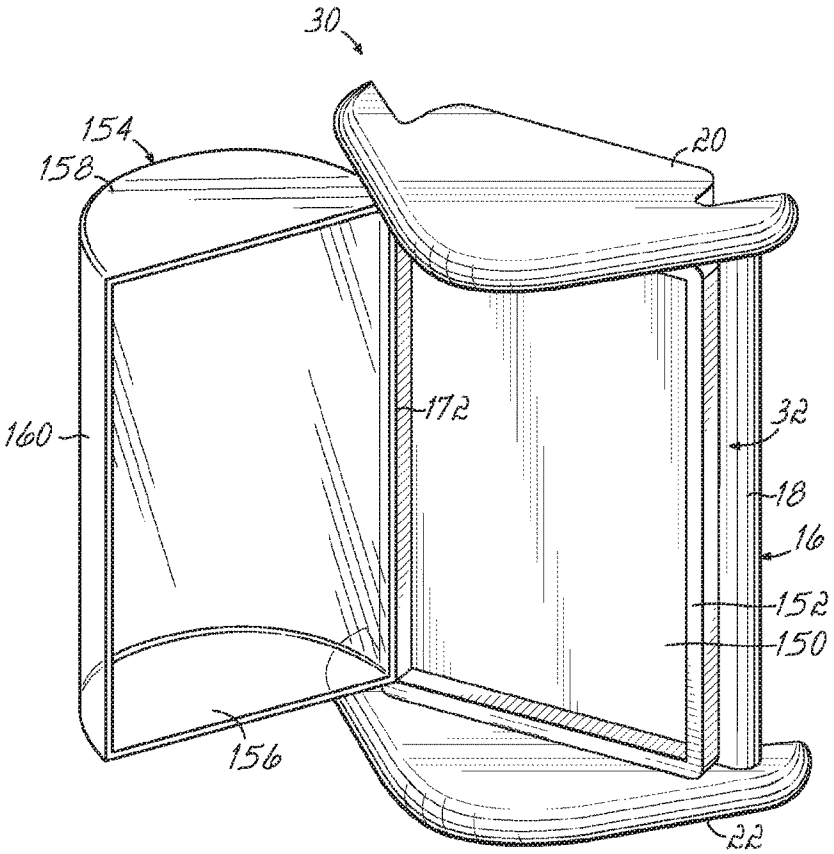

Rather than snapping into or onto the frame 152 of rectangular plate 150, transparent cover 154 could be hinged to a side of the plate 150 or frame 152, as at 172 in FIG. 15.

Figure 16:
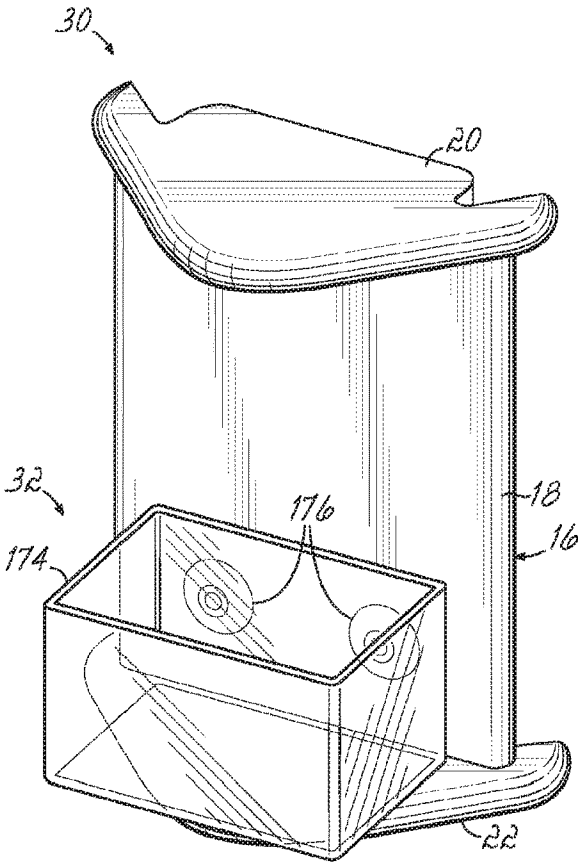
FIG. 16 is a perspective view of another embodiment of the casket ornament base.
Figure 17:
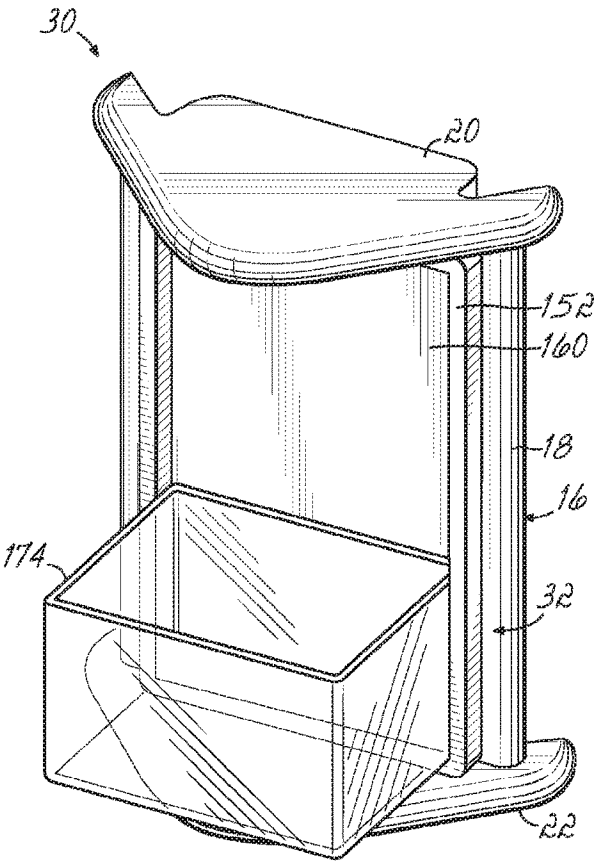
FIG. 17 is a perspective view of another embodiment of the casket ornament base.
Figure 20:
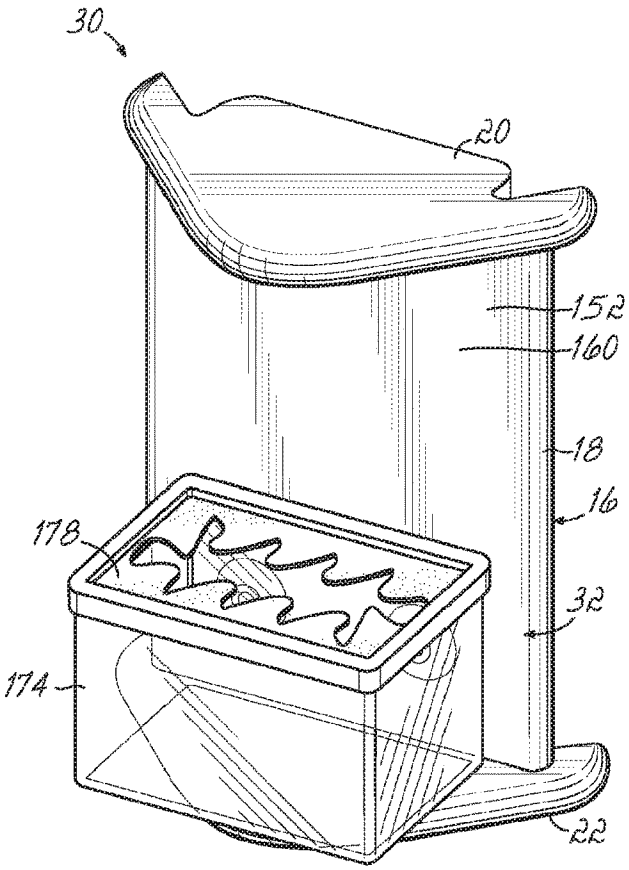
FIG. 20 is a perspective view of another embodiment of the casket ornament base.

Referring to FIG. 16, the transparent cover could be modified into an open-topped receptacle 174 secured to back plate 18 by suction cups, screws, double sided tape, hook and loop, or the like 176. In this embodiment the back plate 18 of corner 16 functions as the ornament base. Alternatively, as shown in FIG. 17, open-topped receptacle 174 could be made to be snapped into frame 152 of plate 150. FIG. 20 illustrates the open-topped receptacle 174 of FIG. 16 with a resilient grabber or gripper element 178 attached around a periphery of the upper lip or edge of receptacle 174, useful in retaining elongated, upstanding items in the receptacle 174. In this embodiment, as with the FIG. 16 embodiment, the back plate 18 of corner 16 functions as the ornament base.

Figure 18B:
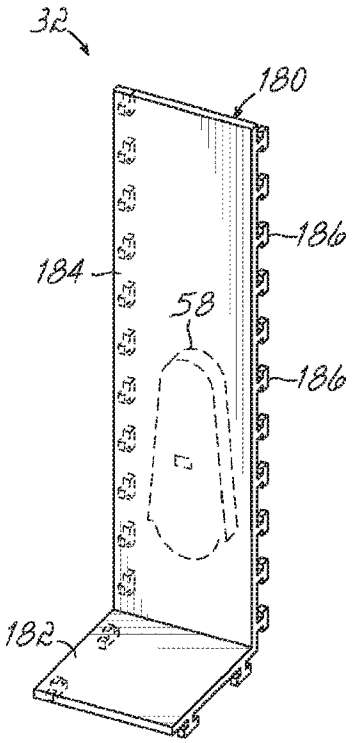
FIGS. 18A and 18B are rear and front perspective views, respectively, of another embodiment of the casket ornament base.
Figure 18A:
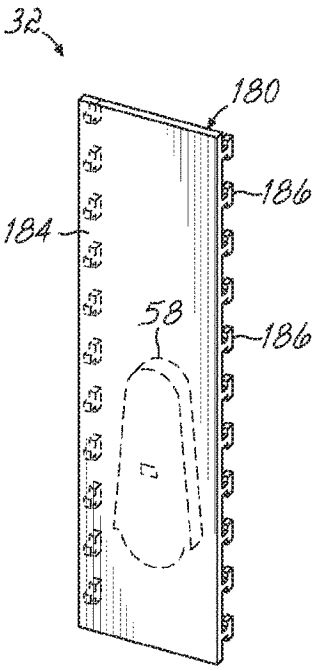

Referring to FIGS. 18A and 18B, another embodiment of ornament base 32 comprises a fairly narrow L-shaped plate 180 having a shelf portion 182 (FIG. 18B) or no shelf portion (FIG. 18A) and a back portion 184. The back portion 184 can include a plurality of rearwardly projecting (toward casket) tabs 186 along the vertical edges of back portion 184 for use with transparent straps, transparent stretch bands, ties, bands, or the like to secure the personal item to the base 32. This embodiment includes the prior described attachment means 56.

Figure 19:
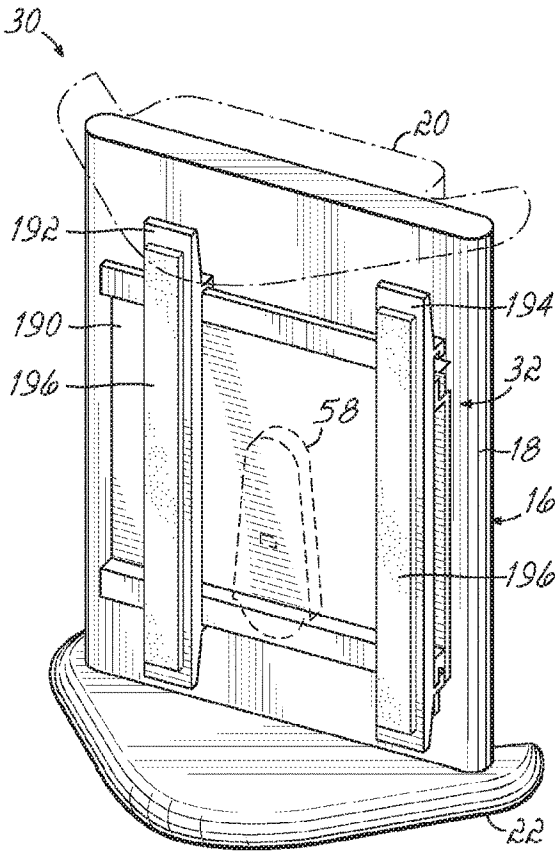
FIG. 19 is a perspective view of another embodiment of the casket ornament base.

Referring to FIG. 19, base 32 can comprise a frame plate 190 having spaced apart generally vertically oriented frame arms 192, 194 movably mounted to the frame plate 190 for horizontal movement. Double sided tape 196 or the like can be utilized to attach the personal item to the frame arms 192, 194 after the arms 192, 194 have been properly adjusted for width.

Upon the death of a loved one, the family member(s) typically make the funeral arrangements with the funeral director for the deceased. A usual part of the arrangements is the selection of a casket and various ornaments to be placed on the casket, for example on the corners of the casket shell or on the cap panel installed in the lid or cap of the casket. Heretofore, the family member has selected from the funeral director's stock on hand of available casket ornaments. The present invention opens up vast new opportunities for personalization of the casket to the deceased by the family. In fact, the family member is able to design (and even construct if they so desire) casket ornaments of their own design, thus not relying on pre-manufactured casket ornaments of finite designs. The present invention allows a loved one to select a personal item, attach (or have attached) the personal item to the ornament base, and attach (or have attached) the ornament base to the chosen casket. The present invention thus provides practically limitless opportunities for personalization of the casket by the family or love one.

As discussed above, various commercially available personal items that are particularly suited for use in the present invention are a hat, a mug, a car, a military medal, a golf ball, a trophy, a doll, a statue/figurine, an article of jewelry, a baseball, a football, a hockey puck, a television remote control, a Bible, a beer bottle, a beer can, a flask, a deck of cards, poker chips, and keys. In addition to purchased Items, items personally owned by the deceased during his/her life can be used. Other personal items other than those listed could also be used and so the invention is not limited in this regard.

Various commercially available means of attaching the personal item to the ornament base can be successfully used. Such means include straps, ties, bands, stretch bands, string, decorative ribbon, leather laces, "twist" ties, "zip" ties, and rubber bands, preferably, but not necessarily, transparent. All such devices shall be generically embraced by the term "ties" as that term is used in the claims. On the ornament base, for use in securing the personal item with the ties (as defined above), various commercially available means such as screws, studs, posts, hooks, clips, tabs, or the like can be used. All such devices shall be generically embraced by the term "hooks" as that term is used in the claims. Other commercially available means that can be used to attach the personal item to the ornament base include hook and loop, adhesives, double sided tape, magnets, sticky putty, shrink wrap, transparent mesh, or the like. As well, the personal item can be attached to the ornament base via the use of a transparent cover that attaches to the ornament base and that contains the personal item, for example the personal item can be supported on a bottom wall of the cover; in this case ties and the like would not be required to attach the personal item to the ornament base.

Various means of attaching the ornament base to the casket shell corner can be successfully used, such means providing either removable attachment or permanent attachment. Such means include studs and magnets, whether with or without the above-described cooperating fittings, as well as the commercially available ties, hook and loop, adhesives, double sided tape, or the like, mentioned above.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. A casket comprising:

a casket shell adapted to receive a deceased, a casket lid closeable on said shell, and a casket ornament attached to said shell, said ornament comprising:

a tangible, physical, three dimensional, non-photograph, non-printed matter personal item of personal significance to the deceased, an ornament base, means for attaching said personal item to said ornament base, and means for attaching said ornament base to said shell, wherein said ornament further includes a transparent cover attached to said base, wherein said transparent cover is distinct from said means for attaching said personal item to said ornament base or is said means for attaching said personal item to said ornament base.

2. The casket of claim 1 wherein said cover slides on said base.

3. The casket of claim 1 wherein said cover snaps on said base.

4. The casket of claim 1 wherein said cover is pivoted to said base.

5. The casket of claim 1 wherein said cover has an open top.

6. The casket of claim 1 wherein said cover is said means for attaching said personal item to said ornament base.

7. The casket of claim 1 wherein the personal item is purchased subsequent to the death of the deceased and prior to the funeral or other memorial service for the deceased.

8. The casket of claim 1 wherein the personal item was owned by the deceased.

* * * * *